US010184186B2

(12) United States Patent
Kita et al.

(10) Patent No.: US 10,184,186 B2
(45) Date of Patent: Jan. 22, 2019

(54) COMPOSITION FOR BLACKENING COPPER-BASED OR SILVER-BASED METALS

(71) Applicant: OKUNO CHEMICAL INDUSTRIES CO., LTD., Osaka-shi, Osaka (JP)

(72) Inventors: Azusa Kita, Osaka (JP); Hiroaki Sakai, Osaka (JP); Joonhaeng Kang, Osaka (JP)

(73) Assignee: OKUNO CHEMICAL INDUSTRIES CO., LTD., Osaka-shi (JP)

( * ) Notice: Subject to any disclaimer, the term of this patent is extended or adjusted under 35 U.S.C. 154(b) by 278 days.

(21) Appl. No.: 15/310,947

(22) PCT Filed: Jun. 15, 2015

(86) PCT No.: PCT/JP2015/067135
§ 371 (c)(1),
(2) Date: Nov. 14, 2016

(87) PCT Pub. No.: WO2015/198899
PCT Pub. Date: Dec. 30, 2015

(65) Prior Publication Data

US 2017/0073818 A1 Mar. 16, 2017

(30) Foreign Application Priority Data

Jun. 24, 2014 (JP) ..... 2014-128863
Dec. 5, 2014 (JP) ..... 2014-246467

(51) Int. Cl.
*C23C 22/52* (2006.01)
*C23C 22/58* (2006.01)
*C23C 22/68* (2006.01)

(52) U.S. Cl.
CPC ..... *C23C 22/58* (2013.01); *C23C 22/52* (2013.01); *C23C 22/68* (2013.01)

(58) Field of Classification Search
CPC ..... C23C 22/52; C23C 22/58; C23C 22/68
See application file for complete search history.

(56) References Cited

U.S. PATENT DOCUMENTS 4,512,818 A 4/1985 Valayil et al.

FOREIGN PATENT DOCUMENTS

| | | | |
|---|---|---|---|
| CN | 101130869 | A | 2/2008 |
| CN | 103313532 | A | 9/2013 |
| JP | 2003-8199 | A | 1/2003 |
| JP | 2009-46761 | A | 3/2009 |
| JP | 2011-70820 | A | 4/2011 |
| JP | 2011-523790 | A | 8/2011 |
| JP | 2014-99473 | A | 5/2014 |
| WO | 2009/148690 | A1 | 12/2009 |

OTHER PUBLICATIONS

Office Action dated Apr. 10, 2018, issued in counterpart Chinese Application No. 2015800325330, with English machine translation. (8 pages).
International Search Report dated Jul. 14, 2015, issued in counterpart International Application No. PCT/JP2015/067135 (2 pages).

*Primary Examiner* — C Melissa Koslow
(74) *Attorney, Agent, or Firm* — Westerman, Hattori, Daniels & Adrian, LLP

(57) ABSTRACT

An object is to provide a novel composition for blackening treatment that can sufficiently blacken copper circuits of printed wiring boards, circuits made of silver paste, and other various articles containing a copper-based metal, such as copper or a copper alloy, or a silver-based metal, such as silver or a silver alloy, without impairing the smoothness of the copper-based metal or silver-based metal. A composition is provided for blackening treatment of a copper-based metal or a silver-based metal, the composition comprising an aqueous solution containing:

(i) at least one water-soluble metal compound selected from the group consisting of water-soluble palladium compounds, water-soluble ruthenium compounds, and water-soluble silver compounds;
(ii) at least one halide selected from the group consisting of hydrohalic acids, metal halides, and ammonium halides; and
(iii) at least one nitrogen atom-containing compound selected from the group consisting of alkylene diamines, polyalkylene polyamines, polyamide polyamines, and crosslinked polyamide polyamines.

4 Claims, No Drawings

COMPOSITION FOR BLACKENING COPPER-BASED OR SILVER-BASED METALS

TECHNICAL FIELD

The present invention relates to a composition for blackening treatment of a copper-based metal or a silver-based metal.

BACKGROUND ART

Display devices, such as touch panels and liquid crystal displays, have problems such that when the copper wiring circuit disposed below the liquid crystal layer has a high reflectance, the influence of the reflection causes a reduction in the appearance of the display device, and deterioration of the display accuracy. Therefore, a reduction in the reflectance by blackening copper circuits and conductor parts comprising other copper materials is required.

As a method for blacking a copper circuit, there is, for example, a known method in which when a printed wiring board is laminated, an uneven oxide film is formed on the surface of a copper circuit formed on an inner layer board to ensure adhesion between the copper surface and a prepreg resin to be laminated. This method is called "blackening treatment," whereby a copper surface is oxidized using hypochlorite, chlorite, or the like in an alkali solution containing a stabilizing agent to form a copper oxide film. There is another method for blackening a copper surface with an aqueous sulfide solution (see PTL 1, described later).

However, the above method for oxidizing a copper surface cannot sufficiently reduce the reflectance because the degree of blackening is not sufficient. Further, sulfide treatment has a problem such that the surface and side of a copper circuit are roughened, reducing wiring accuracy (see PTL 2, described later).

Moreover, in recent years, a method for forming a circuit using conductive silver paste has been implemented as a relatively simple method for forming a wiring circuit. When such a wiring circuit made of silver paste is used in display devices, such as touch panels and liquid crystal displays, a reduction in reflectance by blackening a conductor part comprising silver as a main component is also required.

CITATION LIST

Patent Literature

PTL 1: JP2003-8199A
PTL 2: JP2011-70820A

SUMMARY OF INVENTION

Technical Problem

The present invention was made in view of the current state of the above prior art. A primary object of the present invention is to provide a novel composition for blackening treatment that can sufficiently blacken copper circuits of printed wiring boards, conductor parts and films made of silver paste, and other various articles containing a copper-based metal, such as copper or a copper alloy, or a silver-based metal, such as silver or a silver alloy, without impairing the smoothness of the copper-based metal or silver-based metal.

Solution to Problem

The present inventors conducted extensive research to achieve the above object. As a result, the present inventors found that when an article containing a copper-based metal, such as copper or a copper alloy, or an article containing a silver-based metal, such as silver or a silver alloy, is treated with an aqueous solution containing at least one water-soluble metal compound selected from the group consisting of water-soluble palladium compounds, water-soluble ruthenium compounds, and water-soluble silver compounds, and further containing a halide and a specific compound containing a nitrogen atom, the copper-based metal or the silver-based metal can be sufficiently blackened to reduce the reflectance and improve the decorativeness, without impairing the smoothness of the copper-based metal or silver-based metal. The present invention has thus been completed.

That is, the present invention provides the following compositions for blackening treatment of a copper-based metal or a silver-based metal, and the following blackening treatment method of a copper-based metal or a silver-based metal.

Item 1. A composition for blackening treatment of a copper-based metal or a silver-based metal, the composition comprising an aqueous solution containing:

(i) at least one water-soluble metal compound selected from the group consisting of water-soluble palladium compounds, water-soluble ruthenium compounds, and water-soluble silver compounds;

(ii) at least one halide selected from the group consisting of hydrohalic acids, metal halides, and ammonium halides; and (iii) at least one nitrogen atom-containing compound selected from the group consisting of alkylene diamines, polyalkylene polyamines, polyamide polyamines, and crosslinked polyamide polyamines.

Item 2. A composition for blackening treatment of a copper-based metal or a silver-based metal, the composition comprising an aqueous solution containing:

(i) 0.0001 to 0.5 mol/L, as the concentration of a metal component, of at least one water-soluble metal compound selected from the group consisting of water-soluble palladium compounds, water-soluble ruthenium compounds, and water-soluble silver compounds;

(ii) 0.1 to 500 g/L of at least one halide selected from the group consisting of hydrohalic acids, metal halides, and ammonium halides; and (iii) 0.001 to 100 g/L of at least one nitrogen atom-containing compound selected from the group consisting of alkylene diamines, polyalkylene polyamines, polyamide polyamines, and crosslinked polyamide polyamines.

Item 3. A method for blackening a copper-based metal or a silver-based metal, the method comprising bringing an object to be treated into contact with the composition for blackening treatment according to item 1 or 2, the object to be treated being an article containing a copper-based metal comprising copper or a copper alloy, or an article containing a silver-based metal comprising silver or a silver alloy.

Advantageous Effects of Invention

According to the composition for blackening treatment of the present invention, an article containing a copper-based metal, such as copper metal or a copper alloy, or a silver-based metal, such as silver metal or a silver alloy, is used as an object to be treated, and the copper-based metal portion or the silver-based metal portion can be uniformly blackened, without impairing the smoothness and appearance. Therefore, according to the composition for blackening treatment of the present invention, copper circuits, circuits and film parts made of silver paste and the like used in, for example, touch panels, liquid crystal displays, etc., can be uniformly blackened to reduce the reflection, without reducing wiring accuracy. Further, for various articles containing a copper-based metal, such as copper or a copper alloy, or a silver-based metal, such as silver or a silver alloy, the copper-based metal portion or the silver-based metal portion can be uniformly blackened to impart an excellent decorative appearance.

DESCRIPTION OF EMBODIMENTS

The composition for blackening treatment and the blackening method according to the present invention are described in detail below.

Composition for Blackening Treatment of Copper-Based Metal or Silver-Based Metal The composition for blackening treatment of the present invention is an aqueous solution containing the following components (i) to (iii) as active components:

(i) at least one water-soluble metal compound selected from the group consisting of water-soluble palladium compounds, water-soluble ruthenium compounds, and water-soluble silver compounds;

(ii) at least one halide selected from the group consisting of metal halides and ammonium halides; and (iii) at least one nitrogen atom-containing compound selected from the group consisting of alkylene diamines, polyalkylene polyamines, polyamide polyamines, and crosslinked polyamide polyamines.

Each of the components contained in the composition for blackening treatment of the present invention is described in detail below.

(i) Water-Soluble Metal Compound

In the composition for blackening treatment of the present invention, at least one water-soluble metal compound selected from the group consisting of water-soluble palladium compounds, water-soluble ruthenium compounds, and water-soluble silver compounds is used.

Among these, as for water-soluble palladium compounds, any palladium compound can be used without limitation, as long as it is soluble in the composition for blackening treatment of the present invention. Specific examples thereof include palladium chloride, palladium sulfate, palladium oxide, palladium iodide, palladium bromide, palladium nitrate, palladium acetate, tetraammninepalladium chloride, dinitrodiamminepalladium, dichlorodiethylenediamine palladium, and the like.

As for water-soluble ruthenium compounds, any ruthenium compound can be used as long as it is soluble in the composition for blackening treatment of the present invention. Specific examples thereof include ruthenium chloride, ruthenium nitrate, ruthenate (sodium ruthenate, potassium ruthenate, etc.), ruthenium oxide, and the like.

As for water-soluble silver compounds, any silver compound can be used as long as it is soluble in the composition for blackening treatment of the present invention. Specific examples thereof include silver nitrate, dicyanoargentate, silver acetate, silver oxide, silver methanesulfonate, silver sulfide, silver chloride, and the like.

Water-soluble palladium compounds, water-soluble ruthenium compounds, and water-soluble silver compounds can be used singly or in a mixture of two or more different or same compounds.

The concentration of the water-soluble metal compound is preferably about 0.0001 to 0.5 mol/L, and more preferably about 0.001 to 0.1 mol/L, as the concentration of a metal component contained in the water-soluble metal compound. When the concentration of the water-soluble metal compound is overly low, the copper-based metal and the silver-based metal cannot be sufficiently blackened. In contrast, an overly high concentration of the water-soluble metal compound is not preferable because the cost is high.

(ii) Halide

It is necessary for the composition for blackening treatment of the present invention to contain at least one halide selected from the group consisting of hydrohalic acids, metal halides, and ammonium halides. Due to the addition of such a halide, the water-soluble metal compound can be stably present in the aqueous solution.

Usable halides are chloride, bromide, iodide, and the like. Specific example of halides include hydrohalic acids, such as hydrochloric acid, hydrobromic acid, and hydroiodic acid; metal halides, such as alkali metal halides (e.g., sodium chloride and potassium bromide) and alkaline earth metal halides (e.g., magnesium chloride and calcium iodide); ammonium halides, such as ammonium chloride and ammonium bromide; and the like. In the present invention, these halides can be used singly or in a mixture of two or more.

The concentration of the halide is preferably about 0.1 to 500 g/L, and more preferably about 1 to 300 g/L. When the concentration of the halide is overly low, the stability of the treatment solution decreases. In contrast, an overly high concentration of the halide is not preferable because the cost is high.

(iii) Nitrogen Atom-Containing Compound

In the present invention, it is necessary to use at least one nitrogen atom-containing compound selected from the group consisting of alkylene diamines, polyalkylene polyamines, polyamide polyamines, and crosslinked polyamide polyamines.

Blackening treatment of a copper-based metal or a silver-based metal using a composition for blackening treatment containing such a specific nitrogen atom-containing compound, in addition to a water-soluble metal compound and a halide, allows sufficient blackening of the copper-based metal or the silver-based metal.

In the composition for blackening treatment of the present invention, the concentration of the nitrogen atom-containing compound is preferably about 0.001 to 100 g/L, and more preferably about 0.01 to 50 g/L. A concentration of the nitrogen atom-containing compound outside of the above range is not preferable because the copper-based metal or the silver-based metal cannot be sufficiently blackened.

The nitrogen-containing compounds are described in detail below.

(a) Alkylene Diamine:

Specific examples of alkylene diamines include 1,2-propanediamine, 1,3-propanediamine, hexamethylenediamine, and the like.

(b) Polyalkylene Polyamine:

Specific examples of polyalkylene polyamines include diethylenetriamine, triethylenetetramine, tetraethylenepentamine, pentaethylenehexamine, iminobispropylamine, 3-azahexane-1,6-diamine, 4,7-diazadecane-1,10-diamine, and the like.

(c) Polyamide Polyamine:

Among the nitrogen atom-containing compounds used in the present invention, the polyamide polyamine can be obtained by polycondensation of a polyamine and a dibasic carboxylic acid compound. In addition to a polyamine and a dibasic carboxylic acid compound, other components may be further reacted. Examples of such components include alkylating agents, ureas, oxidants, alicyclic compounds having at least one active hydrogen, and the like.

Among these components, the polyamine can be at least one compound selected from the group consisting of alkylene diamines and polyalkylene polyamines. Such a polyamine can be a compound having two primary amino groups linked via an alkylene to which a secondary amino group may be bound. Among such polyamines, specific examples of alkylene diamines include 1,2-propanediamine, 1,3-propanediamine, hexamethylenediamine, and the like; and specific examples of polyalkylene polyamines include diethylenetriamine, triethylenetetramine, tetraethylenepentamine, pentaethylenehexamine, iminobispropylamine, 3-azahexane-1,6-diamine, 4,7-diazadecane-1,10-diamine, and the like. These polyamines can be used singly or in a mixture of two or more. Of these, diethylenetriamine, triethylenetetramine, etc., are industrially advantageous. Further, the polyamine can be used in combination with a small amount of monoamine or ammonia.

Examples of dibasic carboxylic acid compounds include dibasic carboxylic acids having two carboxyl groups in the molecule, and compounds derived from the dibasic carboxylic acids, such as esters and acid anhydrides. Any of aliphatic, aromatic and alicyclic dibasic carboxylic acid compounds may be used.

Examples of free dibasic carboxylic acids include aliphatic dicarboxylic acids, such as succinic acid, glutaric acid, adipic acid, sebacic acid, maleic acid, and fumaric acid; aromatic dicarboxylic acids, such as phthalic acid, isophthalic acid, and terephthalic acid; alicyclic dicarboxylic acids, such as tetrahydrophthalic acid, hexahydrophthalic acid, cyclohexane-1,3- or -1,4-dicarboxylic acid, cyclopentanedicarboxylic acid, 3- or 4-methyltetrahydrophthalic acid, and 3- or 4-methylhexahydrophthalic acid; and the like. When the alicyclic group has an unsaturated bond, and the position of the unsaturated bond is not specified, the position of the unsaturated bond is not particularly limited. The same applies to the following.

Examples of esters of dibasic carboxylic acids include mono- or diesters of the above free acids and lower alcohols, polyesters of the above free acids and glycols, and the like. Specific examples of acid anhydrides include succinic anhydride, phthalic anhydride, tetrahydrophthalic anhydride, hexahydrophthalic anhydride, 3- or 4-methyl tetrahydrophthalic anhydride, 3- or 4-methyl hexahydrophthalic anhydride, and the like.

Polyesters, which are reaction products of dibasic carboxylic acids and glycols, can also be advantageously used. In particular, those having a free carboxyl group are preferred. Examples of glycols usable herein include alkylene glycols, such as ethylene glycol, propylene glycol, and butanediol; cycloalkylene glycols, such as cyclopentanediol and cyclohexanediol; alkenylene glycols, such as butenediol and octenediol; polyalkylene glycols, such as diethylene glycol, dipropylene glycol, triethylene glycol, polyethylene glycol, and polytetramethylene glycol; ethylene oxide adducts of bisphenol A, and the like. In the reaction of a dibasic carboxylic acid and a glycol, when the carboxylic acid is reacted at an excess molar ratio, a polyester terminated with a free carboxyl group is obtained. Dibasic carboxylic acid compounds can be used singly or in combination of two or more.

The reaction between a polyamine and a dibasic carboxylic acid compound is a polycondensation reaction by dehydration or dealcoholization, whereby a polyamide polyamine is formed.

The amount of the dibasic carboxylic acid compound used is generally 0.1 to 2 moles, preferably 0.2 to 1.2 moles, per mole of the polyamine.

In this reaction, a mineral acid, sulfonic acid, or the like can be used as a catalyst. Examples of mineral acids include hydrochloric acid, sulfuric acid, nitric acid, phosphoric acid, and the like. Examples of sulfonic acids include benzenesulfonic acid, paratoluenesulfonic acid, and the like. Of these, sulfuric acid, benzenesulfonic acid, paratoluenesulfonic acid, etc., are preferred. When a catalyst is used, the amount of the catalyst used is generally about 0.005 to 0.1 moles, and preferably about 0.01 to 0.05 moles, per mole of the total of primary and secondary amino groups of the polyamine.

Examples of the method for reacting a polyamine and a dibasic carboxylic acid compound include a method for reacting them while removing water, etc., at about 50 to 250° C. under ordinary pressure or reduced pressure. For example, water may be added and reacted in order to control rapid heat generation in the beginning of the reaction. The amount of water may be an amount necessary for suppressing rapid heat generation, and is generally about 0.1 to 30 parts by weight based on the total amount of 100 parts by weight of the polyamine and the dibasic carboxylic acid compound.

This reaction may be generally performed until the viscosity of the reaction solution containing a polyamide polyamine, which is the resulting polycondensation product, measured at 25° C. with a water content of 50 wt. % is about 50 mPa·s or more, and preferably about 100 to 1,000 mPa·s.

Moreover, the polyamide polyamine may be obtained by further reacting other components, in addition to a polyamine and a dibasic carboxylic acid compound. Examples of such components include at least one compound selected from the group consisting of alkylating agents, ureas, oxidants, and alicyclic compounds having at least one active hydrogen (hereinafter referred to as a "modifying component"). As a result of reacting such a modifying component, the degree of cationization of water solubility can be increased.

Among the above modifying components, examples of alkylating agents include halogenated hydrocarbons, such as methyl chloride, methyl bromide, methyl iodide, ethyl chloride, ethyl bromide, ethyl iodide, allyl chloride, benzyl chloride, and 2-chloroethyl dimethylamine; halogenated acetates, such as methyl chloroacetate, methyl bromoacetate, ethyl chloroacetate, and ethyl bromoacetate; chlorohydrins, such as ethylene chlorohydrin and 3-chloro-2-hydroxypropyl trimethylammonium chloride; epoxy compounds, such as propylene oxide, glycidol, styrene oxide, and 1,2-epoxybutane; alkyl sulfate esters, such as dimethyl sulfate and diethyl sulfate; and the like. These alkylating agents can be used singly or in a mixture of two or more. Of these, halogenated hydrocarbons, halogenated acetates, halogen-free epoxy compounds, alkyl sulfate esters, etc., are preferred; in particular, alkyl sulfate esters are preferred.

Moreover, usable ureas generally include ureas having an atomic group represented by the formula: —NHC(=Q)NHR, and derivatives thereof. In the formula, Q represents oxygen or sulfur, and R represents hydrogen or alkyl having about 1 to 4 carbon atoms. Specific examples thereof include urea, thiourea, guanylurea, methylurea, dimethylurea, and the like. Ureas can be used singly or in a combination of two or more. Urea is industrially preferable.

Examples of oxidants include hydrogen peroxide, ozone, alkali metal hypochlorite, inorganic or organic peroxides, and the like; in particular, hydrogen peroxide is preferred.

Examples of alicyclic compounds having at least one active hydrogen include alicyclic amines, alicyclic epoxy compounds, and the like. Among these, alicyclic amines are generally compounds that have an alicyclic ring having about 5 to 12 ring-carbon atoms, preferably a cyclohexane ring, and that have at least one primary or secondary amino group. This amino group may be directly bonded to the alicyclic ring, or indirectly bonded to the alicyclic ring through a linking group, such as an alkylene. Specific examples of alicyclic amines having at least one active hydrogen include cyclohexylamine, dicyclohexylamine, N-methylcyclohexylamine, 1,3- or 1,4-diaminocyclohexane, 4,4'-diamino-3,3'-dimethyldicyclohexylmethane, 4,4'-diamino-3,3'-dimethylbicyclohexyl, isophoronediamine, 1,3-, 1,2- or 1,4-bis(aminomethyl)cyclohexane, N-aminopropylcyclohexylamine, 1,5-, or 2,6-bis(aminomethyl)octahydro-4,7-methanoindene, 2,2-bis(4-aminocyclohexyl)propane, bis(4-aminocyclohexyl)methane, 4,4'-oxybis(cyclohexylamine), 4,4'-sulfonebis(cyclohexylamine), 1,3,5-triaminocyclohexane, 2,4'- or 4,4'-diamino-3,3',5,5'-tetramethyl dicyclohexylmethane, menthanediamine, N-methyl-1,3-diaminocyclohexane, N,N-dimethyl-1,3-diaminocyclohexane, 3-N-methylamino-3,5,5-trimethyl cyclohexylamine, N,N-dimethylbis(4-aminocyclohexyl) methane, and the like.

The above modifying components, i.e., alkylating agents, ureas, oxidants, and alicyclic compounds having at least one active hydrogen, can be used singly or in a combination of two or more.

A modifying component can be reacted in any stage of the production process of a polyamide polyamine. For example, after a polyamine and a dibasic carboxylic acid compound are reacted to form a polyamide polyamine, the obtained polyamide polyamine can be reacted with a modifying component.

The modifying component is reacted with the primary, secondary, or tertiary amino group of the polyamide polyamine, or the primary or secondary amino group of the polyamine polyamide, thereby increasing the amino group valence. In particular, the reaction with a tertiary amino group forms a quaternary amino group, thereby increasing the degree of cationization.

The reaction between the modifying component and the polyamide polyamine is generally performed in an aqueous solution. The water content is preferably equal to or higher than the water content in the reaction of the polyamide polyamine and a crosslinkable compound described later. The reaction temperature with the modifying component is generally about 10 to 80° C., preferably about 15 to 75° C., and particularly preferably about 20 to 70° C.

The amount of the modifying component used is generally about 0.3 to 2 moles, preferably about 0.5 to 1 mole, per mole of the total of primary, secondary, and tertiary amino groups of the polyamide polyamine.

(d) Crosslinked Polyamide Polyamine

The crosslinked polyamide polyamine can be obtained by reacting the above polyamide polyamine and a crosslinkable compound.

The crosslinkable compound can be at least one compound selected from the group consisting of aldehydes, epihalohydrins, α,γ-dihalo-β-hydrins, glycidyl compounds, and isocyanates.

Of these crosslinkable compounds, aldehydes may be compounds that have at least one —CHO group in the molecule. Examples thereof include alkyl aldehydes, such as formaldehyde, acetaldehyde, and propionaldehyde; alkyl dialdehydes, such as glyoxal, propanedial, and butanedial; and the like. Formaldehyde, glyoxal, etc., are industrially advantageous.

Of the crosslinkable compounds, epihalohydrins are compounds represented by the following formula:

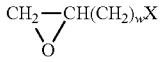

wherein X represents a halogen atom, such as chlorine, bromine, or iodine, and w is 1, 2, or 3. Preferable examples of epihalohydrins include epichlorohydrin, epibromohydrin, and the like.

Of the crosslinkable compounds, α,γ-dihalo-β-hydrins are compounds represented by the following formula:

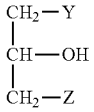

wherein Y and Z are the same or different, and each represent a halogen atom, such as chlorine, bromine, or iodine. Specific examples of α,γ-dihalo-β-hydrins include 1,3-dichloro-2-propanol, and the like.

Among the crosslinkable compounds, glycidyl compounds are compounds having at least two glycidyl groups in the molecule. Specific examples thereof include alkylene glycol diglycidyl ethers, such as ethylene glycol diglycidyl ether and propylene glycol diglycidyl ether; polyoxyalkylene glycol diglycidyl ethers, such as polyethylene glycol diglycidyl ether and polypropylene glycol diglycidyl ether; aromatic diglycidyl ethers, such as resorcinol diglycidyl ether and bisphenol A diglycidyl ether; trimethylolpropane di- or triglycidyl ether, sorbitol di-, tri-, tetra-, penta- or hexaglycidyl ether, pentaerythritol di-, tri-, or tetraglycidyl ether, and the like.

Among the crosslinkable compounds, isocyanates are compounds having at least two isocyanato groups in the molecule. Specific examples thereof include alicyclic isocyanates, such as isophorone diisocyanate, 3-(2-isocyanatocyclohexyl)propylisocyanate, bis(isocyanatomethyl)cyclohexane, isopropylidenebis(cyclohexylisocyanate), trans-cyclohexane-1,4-diisocyanate, and bicycloheptane triisocyanate; aliphatic isocyanates, such as hexamethylene diisocyanate, trimethylhexane-1,6-diisocyanate, and methyl-2,6-diisocyanatehexanoate (also referred to as lysine diisocyanate); and aromatic isocyanates, such as tolylene diisocyanate, triphenylmethane triisocyanate, tris(isocyanatophenyl)thiophosphate, phenylene diisocyanate, dianisidine diisocyanate, and diphenylether diisocyanate.

These crosslinkable compounds, including aldehydes, epihalohydrins, α,γ-dihalo-β-hydrins, glycidyl compounds, and isocyanates, can be used singly or in a combination of two or more. Among aldehydes, epihalohydrins, α,γ-dihalo- β-hydrins, glycidyl compounds, and isocyanates, two or more of different types can be used in combination.

The crosslinkable compound may be reacted in any order, and the order is not limited. For example, after a polyamine and a dibasic carboxylic acid compound are reacted to form a polyamide polyamine, the resulting polyamide polyamine can be reacted with a crosslinkable compound. When the secondary amino group part of the polyamide polyamine structure and the unreacted primary amino groups remain as a result of this reaction, the primary amine part is reacted with the crosslinkable compound to form a crosslinked structure. Moreover, the tertiary amino group formed by the reaction is further reacted with the crosslinkable compound to become a quaternary amino group, and the degree of cationization increases.

When the polyamide polyamine contains a modifying component, a polyamide polyamine obtained by reacting a modifying component may be reacted with a crosslinkable compound; or a polyamide polyamine obtained by polycondensation of a polyamine and a dibasic carboxylic acid compound may be reacted with a crosslinkable compound, and then reacted with a modifying component.

The amount of the crosslinkable compound used is generally about 0.1 to 2 moles, preferably about 0.2 to 1.1 moles, per mole of the total of primary and secondary amino groups of the polyamide polyamine.

This reaction is generally performed in an aqueous solution. The water content is generally about 30 to 80 wt. %, and preferably about 40 to 70 wt. %. It is not preferable to perform the reaction with a water content of greater than 80%, because the reaction rate tends to decrease. It is not preferable to perform the reaction with a water content of less than 30%, because the reaction rate tends to increase, and the reaction mixture tends to gel.

The reaction temperature of the polyamide polyamine and the crosslinkable compound is generally about 10 to 80° C., preferably about 15 to 70° C., and more preferably about 20 to 60° C. The reaction between the polyamide polyamine and the crosslinkable compound may be performed until, for example, the amount of the unreacted crosslinkable compound is about 10% or less based on the amount of the crosslinkable compound used.

The crosslinked polyamide polyamine preferably has a viscosity measured at 25° C. with a water content of 85 wt. % of about 1 to 300 mPa·s, and preferably about 2 to 200 mPa·s. The weight average molecular weight of the polyamide polyamine that provides this viscosity is about 1,000 to 1,000,000. The degree of cationization, which indicates the ratio of quaternary amino groups to the total amount of primary, secondary, tertiary, and quaternary amino groups contained in a water-soluble resin, is preferably 10% to 90%.

Blackening Treatment Method of Copper-Based Metal or Silver-Based Metal

The object to be treated by the composition for blackening treatment of the present invention is a copper-based metal comprising copper or a copper alloy, or a silver-based metal comprising silver or a silver alloy. Examples of copper alloys and silver alloys include alloys containing 50 wt. % or more, and preferably 70 wt. % or more, of copper or silver, respectively.

The specific type of the copper-based metal and silver-based metal to be treated is not particularly limited. Examples of the copper-based metal include copper circuit parts, such as circuit parts of printed wiring boards, formed by electroless plating, electroplating, or the like. Examples of the silver-based metal include circuit parts, film parts, etc., made of silver paste formed in semiconductor packages, electronic components, etc.

According to the composition for blackening treatment of the present invention, blackening treatment can be performed using such a copper-based metal or silver-based metal as an object to be treated. Thereby, the reflectance of copper circuit parts, and circuits, films, etc., made of silver paste, can be reduced.

In addition, blackening treatment can be performed on various articles containing a copper-based metal, such as copper or a copper alloy, or a silver-based metal, such as silver or a silver alloy, to thereby uniformly blacken the copper-based metal portion or the silver-based metal portion. As a result, excellent decorativeness can be imparted.

The method for performing blackening treatment of a copper-based metal or a silver-based metal using the composition for blackening treatment of the present invention is not particularly limited. As required, in order to remove dirt and oxide films on the surface of an object to be treated, degreasing or immersion in an acidic solution, such as sulfuric acid or hydrochloric acid, may be performed in a standard manner, followed by water-washing, and the composition for blackening treatment may be then brought into contact with the object to be treated, i.e., a copper-based metal or silver-based metal. The specific method for bringing the composition for blackening treatment into contact with a copper-based metal or a silver-based metal is not particularly limited. In general, an article containing a copper-based metal or a silver-based metal may be immersed in the composition for blackening treatment. Alternatively, blackening treatment of a copper-based metal or a silver-based metal can be performed by, for example, a method for spraying the composition for blackening treatment on the surface of the copper-based metal or the silver-based metal.

When the composition for blackening treatment of the present invention is used by an immersion method, the solution temperature of the composition for blackening treatment is generally preferably about 10 to 90° C., and more preferably about 20 to 60° C.

The pH of the composition for blackening treatment during blackening treatment is preferably about 0 to 13, and more preferably about 0 to 8.

The treatment time of blackening treatment may be set so that desired blackening can be achieved. When the treatment is performed by an immersion method, the treatment time is generally about 0.1 to 10 minutes.

The blackening treatment performed in the above manner can be optionally followed by washing and drying, thereby obtaining an article having a uniformly blackened copper-based metal portion or silver-based metal portion.

EXAMPLES

The present invention is described in more detail below with reference to Examples.

Production Example 1

Diethylenetriamine (55 parts by weight), phthalic acid (29 parts by weight), water (10 parts by weight), and 98% sulfuric acid (6 parts by weight) were placed in a reaction vessel equipped with a thermometer, a Liebig condenser, and a stirrer, and dehydration was performed at 150 to 160° C. for 15 hours. Then, ion exchange water was added to the resulting reaction mixture to adjust the resin concentration to 50 wt. %, thereby obtaining an aqueous solution of polyamide amine resin having a viscosity of 680 Pas and a total amount of primary and secondary amino groups of 2.578 mmol/g. This aqueous solution is regarded as polyamide polyamine 1.

Production Example 2

Diethylenetriamine (72 parts by weight), adipic acid (22 parts by weight), water (3 parts by weight), and 98% sulfuric acid (3 parts by weight) were placed in a reaction vessel equipped with a thermometer, a Liebig condenser, and a stirrer, and dehydration was performed at 150 to 160° C. for 15 hours. Then, ion exchange water was added to the resulting reaction mixture to adjust the resin concentration to 50 wt. %, thereby obtaining an aqueous solution of polyamide amine resin having a viscosity of 650 Pas and a total amount of primary and secondary amino groups of 3.1 mmol/g. This aqueous solution is regarded as polyamide polyamine 2.

Production Example 3

Triethylenetriamine (30 parts by weight), succinic acid (30 parts by weight), water (30 parts by weight), and 98% sulfuric acid (10 parts by weight) were placed in a reaction vessel equipped with a thermometer, a Liebig condenser, and a stirrer, and dehydration was performed at 150 to 160° C. for 15 hours. Then, ion exchange water was added to the resulting reaction mixture to adjust the resin concentration to 50 wt. %, thereby obtaining an aqueous solution of polyamide amine resin having a viscosity of 620 Pas and a total amount of primary and secondary amino groups of 3.2 mmol/g. This aqueous solution is regarded as polyamide polyamine 3.

Production Example 4

Diethylenetriamine (39 parts by weight), maleic acid (40 parts by weight), water (20 parts by weight), and 98% sulfuric acid (1 part by weight) were placed in a reaction vessel equipped with a thermometer, a Liebig condenser, and a stirrer, and dehydration was performed at 150 to 160° C. for 15 hours. Then, ion exchange water was added to the resulting reaction mixture to adjust the resin concentration to 50 wt. %, thereby obtaining an aqueous solution of polyamide amine resin having a viscosity of 611 Pas and a total amount of primary and secondary amino groups of 3.0 mmol/g. This aqueous solution is regarded as polyamide polyamine 4.

Production Example 5

Polyamide polyamine 1 (55.1 parts by weight) obtained in Production Example 1 and water (30.2 parts by weight) were placed in a reaction vessel equipped with a thermometer, a reflux condenser, and a stirrer. While warming the mixture to 30° C., epichlorohydrin (10 parts by weight) was added dropwise over 2 hours, followed by reaction for 4 hours.

After ion exchange water (2.7 parts by weight) was added dropwise thereto, the temperature was raised to 50° C. Immediately after the temperature reached 50° C., water (1.9 parts by weight) was added dropwise, and the pH of the reaction mixture was adjusted to 3.4 using sulfuric acid. Water was further added to dilute the mixture to a resin concentration of 15%, thereby obtaining an aqueous solution of water-soluble resin having a viscosity of 6.4 mPa·s, a degree of cationization of 19.2%, and a total amount of primary, secondary, and tertiary amino groups of 0.387 mmol/g. This aqueous solution is regarded as crosslinked polyamide polyamine 1.

Production Example 6

Polyamide polyamine 1 (35.1 parts by weight) and water (31.2 parts by weight) were placed, as in Production Example 5. While warming the mixture to 30° C., epichlorohydrin (23.3 parts by weight) was added dropwise over 5 hours, followed by reaction for 10 hours. After ion exchange water (10.7 parts by weight) was added dropwise thereto, the temperature was raised to 50° C. Immediately after the temperature reached 50° C., water (1.6 parts by weight) was added dropwise, and the pH of the reaction mixture was adjusted to 3.4 using sulfuric acid. Water was further added to dilute the mixture to a resin concentration of 15%, thereby obtaining an aqueous solution of water-soluble resin having a viscosity of 6.4 mPa·s, a degree of cationization of 29.0%, and a total amount of primary, secondary, and tertiary amino groups of 0.444 mmol/g. This aqueous solution is regarded as crosslinked polyamide polyamine 2.

Production Example 7

Polyamide polyamine 2 (30.3 parts by weight) obtained in Production Example 2 and water (39 parts by weight) were placed in a reaction vessel equipped with a thermometer, a reflux condenser, and a stirrer. While warming the mixture to 30° C., epichlorohydrin (18 parts by weight) was added dropwise over 2 hours, followed by reaction for 6 hours.

After ion exchange water (2.7 parts by weight) was added dropwise thereto, the temperature was raised to 50° C. Immediately after the temperature reached 50° C., water (211.6 parts by weight) was added dropwise, and the pH of the reaction mixture was adjusted to 3.4 using sulfuric acid. Water was further added to dilute the mixture to a resin concentration of 15%, thereby obtaining an aqueous solution of water-soluble resin having a viscosity of 6.0 mPa·s, a degree of cationization of 23.3%, and a total amount of primary, secondary, and tertiary amino groups of 0.41 mmol/g. This aqueous solution is regarded as crosslinked polyamide polyamine 3.

Production Example 8

Polyamide polyamine 2 (30.3 parts by weight) obtained in Production Example 2 and water (29.9 parts by weight) were placed in a reaction vessel equipped with a thermometer, a reflux condenser, and a stirrer. While warming the mixture to 30° C., polyethylene glycol diglycidyl ether (11.1 parts by weight) was added dropwise over 2 hours, followed by reaction for 4 hours.

After ion exchange water (9.1 parts by weight) was added dropwise thereto, the temperature was raised to 50° C. Immediately after the temperature reached 50° C., water (200.9 parts by weight) was added dropwise, and the pH of the reaction mixture was adjusted to 3.4 using sulfuric acid. Water was further added to dilute the mixture to a resin concentration of 15%, thereby obtaining an aqueous solution of water-soluble resin having a viscosity of 6.2 mPa·s, a degree of cationization of 21.3%, and a total amount of primary, secondary, and tertiary amino groups of 0.30 mmol/g. This aqueous solution is regarded as crosslinked polyamide polyamine 4.

Example 1

A rolled copper plate (length 5 cm×5 cm×thickness 0.2 mm) was used as an object to be treated, and immersed in a commercially available immersion cleaner (trade name: DP-320 Clean, produced by Okuno Chemical Industries Co., Ltd.) at 45° C. for 1 minute to perform degreasing treatment, followed by water-washing. Thereafter, the object to be treated was immersed in each of blackening treatment solutions Nos. 1 to 10 having the compositions shown in the following Table 1 at 30° C. for 3 minutes to perform blackening treatment.

TABLE 1

| | Blackening treatment solution No. | | | | | | | | | |
|---|---|---|---|---|---|---|---|---|---|---|
| Compound name | 1 | 2 | 3 | 4 | 5 | 6 | 7 | 8 | 9 | 10 |
| Palladium compound (mol/L) | | | | | | | | | | |
| Palladium sulfate | 0.005 | | | | | | 0.2 | | | |
| Palladium chloride | | 0.1 | | 0.01 | | 0.01 | | 0.01 | 0.05 | 0.3 |
| Dichloroethylenediamine palladium | | | 0.1 | | 0.05 | | | | | |
| Halide (g/L) | | | | | | | | | | |
| Hydrochloric acid | | 100 | | | | | | | | |
| Ammonium chloride | | 100 | | 50 | 100 | | | | 200 | |
| Sodium chloride | | | 100 | | | 100 | | | | 200 |
| Sodium bromide | 10 | | | | | | 100 | 100 | | |
| Nitrogen atom-containing compound (g/L) | | | | | | | | | | |
| Diethylenetetramine | | 5 | | | | | | | | |
| Triethylenetetramine | 10 | | 10 | | | | | | | |
| Polyamide polyamine 1 | | | 1 | | | | 200 | | | |
| Polyamide polyamine 2 | | | | 50 | 10 | | | | | |
| Polyamide polyamine 3 | | | | | 100 | | | | | 5 |
| Polyamide polyamine 4 | | | | | | 10 | | | | |
| Crosslinked polyamide polyamine 1 | | | | | | 100 | | | | |
| Crosslinked polyamide polyamine 2 | | | | | | | | 100 | | |
| Crosslinked polyamide polyamine 3 | | | | | | | | | 100 | 5 |
| Crosslinked polyamide polyamine 4 | | | | | | | 1 | | | 1 |
| Bath pH | 2 | 2 | 7 | 3 | 7 | 5 | 5 | 5 | 5 | 5 |

The color tone of each sample after the treatment was visually observed. Further, the reflectance of light at a wavelength of 400 nm and 700 nm was measured using a light reflectance meter.

Moreover, blackening treatment was performed in the same manner as in the above method using, as an object to be treated, a printed wiring board in which a copper wiring circuit having a line width of about 3 to 5 μm was formed on a substrate material comprising a resin. The surface and side of the copper wiring part was observed by a scanning electron microscope (SEM) at 4,000-fold magnification, and the smoothness of the wiring part was evaluated. The observation results are as follows: smooth: +, rough: −. Table 2 below shows the above results.

As comparative tests for a case where blackening treatment was not performed (untreated), and for a case where after degreasing treatment was performed as in Example 1, sulfide treatment or chlorite treatment was performed as the blackening treatment, the reflectance, the color tone of the rolled copper plate, and the smoothness of wiring were evaluated in the same manner as in the above method.

As the sulfide treatment, immersion in an aqueous solution containing 5 ml/L of ammonium sulfate was performed at 25° C. for 3 minutes. As the chlorite treatment, immersion in an aqueous solution containing 30 g/L of sodium chlorite, 10 g/L of sodium hydroxide, and 10 g/L of sodium phosphate was performed at 25° C. for 3 minutes.

TABLE 2

| Type of blackening treatment solution | | Reflectance (%) Wavelength (λ) 400 nm | 700 nm | Color tone of rolled copper plate | Smoothness of wiring |
|---|---|---|---|---|---|
| Untreated | | 38.8 | 93.2 | Shiny (copper-colored) | + |
| Blackening treatment solution | 1 | 10.6 | 13.7 | Black | + |
| | 2 | 7.7 | 5.8 | Black | + |
| | 3 | 10.6 | 14.0 | Black | + |
| | 4 | 12.1 | 8.2 | Black | + |
| | 5 | 9.6 | 7.3 | Black | + |
| | 6 | 12.2 | 11.4 | Black | + |
| | 7 | 12.4 | 11.0 | Black | + |
| | 8 | 12.4 | 8.9 | Black | + |
| | 9 | 12.3 | 13.4 | Black | + |
| | 10 | 11.3 | 14.6 | Black | + |
| Sulfide treatment | | 13.5 | 15.4 | Black | − |
| Chlorite treatment | | 25.7 | 28.7 | Brown to shiny | + |

As is clear from the above results, it was confirmed that when blackening treatment was performed using the blackening treatment solutions Nos. 1 to 10, which were the compositions for blackening treatment of the present invention, the copper plate was uniformly blackened, and the reflectance was significantly reduced. Moreover, when a printed wiring board having a copper wiring circuit was used as an object to be treated, the smoothness of the surface and side of the wiring circuit could be maintained.

In contrast, when sulfide treatment was performed, a certain degree of blackening was achieved; however, the reduction in reflectance was insufficient. Further, the side and surface of the copper circuit were roughened to reduce the smoothness. When chlorite treatment was performed, the degree of blackening was insufficient, and the reflectance could not be sufficiently reduced.

These results confirmed that the use of the compositions for blackening treatment of the present invention allowed sufficient blackening of the copper-based materials, and resulted in a significant reduction in the reflectance, almost without reducing the smoothness.

Example 2

Blackening treatment of rolled copper plates was performed in the same manner as in Example 1, except that each of blackening treatment solutions Nos. 11 to 30 having the compositions shown in the following Tables 3 and 4 was used.

TABLE 3

| | Blackening treatment solution No. | | | | | | | | | |
|---|---|---|---|---|---|---|---|---|---|---|
| Compound name | 11 | 12 | 13 | 14 | 15 | 16 | 17 | 18 | 19 | 20 |
| Ruthenium compound (mol/L) | | | | | | | | | | |
| Ruthenium chloride | 0.005 | | | | | | 0.2 | | | |
| Ruthenium nitrate | | 0.1 | | 0.01 | | 0.01 | | 0.01 | 0.05 | 0.3 |
| Ruthenate | | | 0.1 | | 0.05 | | | | | |
| Halide (g/L) | | | | | | | | | | |
| Hydrochloric acid | | 100 | | | | | | | | |
| Ammonium chloride | | 100 | | 50 | 100 | | | | 200 | |
| Sodium chloride | | | 100 | | | 100 | | | | 200 |
| Sodium bromide | 10 | | | | | | 100 | 100 | | |
| Nitrogen atom-containing compound (g/L) | | | | | | | | | | |
| Diethylenetetramine | | 5 | | | | | | | | |
| Triethylenetetramine | 10 | | 10 | | | | | | | |
| Polyamide polyamine 1 | | | 1 | | | | 200 | | | |
| Polyamide polyamine 2 | | | | 50 | 10 | | | | | |
| Polyamide polyamine 3 | | | | | 100 | | | | | 5 |
| Polyamide polyamine 4 | | | | | | 10 | | | | |
| Crosslinked polyamide polyamine 1 | | | | | | 100 | | | | |
| Crosslinked polyamide polyamine 2 | | | | | | | | 100 | | |
| Crosslinked polyamide polyamine 3 | | | | | | | | | 100 | 5 |
| Crosslinked polyamide polyamine 4 | | | | | | | 1 | | | 1 |
| Bath pH | 2 | 2 | 7 | 3 | 7 | 5 | 5 | 5 | 5 | 5 |

TABLE 4

| | Blackening treatment solution No. | | | | | | | | | |
|---|---|---|---|---|---|---|---|---|---|---|
| Compound name | 21 | 22 | 23 | 24 | 25 | 26 | 27 | 28 | 29 | 30 |
| Silver compound (mol/L) | | | | | | | | | | |
| Silver nitrate | 0.005 | | | | | | 0.2 | | | |
| Potassium dicyanoargentate | | 0.1 | | 0.01 | | 0.01 | | 0.01 | 0.05 | 0.3 |
| Silver acetate | | | 0.1 | | 0.05 | | | | | |
| Halide (g/L) | | | | | | | | | | |
| Ammonium chloride | | 100 | | 50 | 100 | | | | 200 | |
| Sodium chloride | | 100 | 100 | | | 100 | | | | 200 |
| Sodium bromide | 10 | | | | | | 100 | 100 | | |
| Nitrogen atom-containing compound (g/L) | | | | | | | | | | |
| Diethylenetetramine | | 5 | | | | | | | | |
| Triethylenetetramine | 10 | | 10 | | | | | | | |
| Polyamide polyamine 1 | | | 1 | | | | 200 | | | |
| Polyamide polyamine 2 | | | | 50 | 10 | | | | | |
| Polyamide polyamine 3 | | | | | 100 | | | | | 5 |
| Polyamide polyamine 4 | | | | | | 10 | | | | |

TABLE 4-continued

| Compound name | Blackening treatment solution No. 21 | 22 | 23 | 24 | 25 | 26 | 27 | 28 | 29 | 30 |
|---|---|---|---|---|---|---|---|---|---|---|
| Crosslinked polyamide polyamine 1 | | | | | | 100 | | | | |
| Crosslinked polyamide polyamine 2 | | | | | | | | 100 | | |
| Crosslinked polyamide polyamine 3 | | | | | | | | | 100 | 5 |
| Crosslinked polyamide polyamine 4 | | | | | | | 1 | | | 1 |
| Bath pH | 2 | 2 | 7 | 3 | 7 | 5 | 5 | 5 | 5 | 5 |

As in Example 1, the color tone of each sample after the treatment was observed, and the reflectance of light at a wavelength of 400 nm and 700 nm was measured. Further, as in Example 1, blackening treatment was performed using, as an object to be treated, a printed wiring board in which a copper wiring circuit was formed, and the smoothness of the wiring part was evaluated. Table 5 below shows the results.

TABLE 5

| Type of blackening treatment solution | | Reflectance (%) Wavelength (λ) 400 nm | 700 nm | Color of rolled copper plate | Smoothness of wiring |
|---|---|---|---|---|---|
| Blackening treatment solution No. | 11 | 9.9 | 11.5 | Black | + |
| | 12 | 8.5 | 12.6 | Black | + |
| | 13 | 10.6 | 12.9 | Black | + |
| | 14 | 12.1 | 13.1 | Black | + |
| | 15 | 11.1 | 12.7 | Black | + |
| | 16 | 9.9 | 11.5 | Black | + |
| | 17 | 10.9 | 12.7 | Black | + |
| | 18 | 11.5 | 12.2 | Black | + |
| | 19 | 6.7 | 8.9 | Black | + |
| | 20 | 8.4 | 9.4 | Black | + |
| | 21 | 9.9 | 10.6 | Black | + |
| | 22 | 11.3 | 13.1 | Black | + |
| | 23 | 10.5 | 11.4 | Black | + |
| | 24 | 8.1 | 11.3 | Black | + |
| | 25 | 11.4 | 13.1 | Black | + |
| | 26 | 9.6 | 11.5 | Black | + |
| | 27 | 11.5 | 13.9 | Black | + |
| | 28 | 12.4 | 14.5 | Black | + |
| | 29 | 12.1 | 14.8 | Black | + |
| | 30 | 8.9 | 11.2 | Black | + |

As is clear from the above results, it was confirmed that even when blackening treatment was performed using blackening treatment solutions Nos. 11 to 30 containing a ruthenium compound or a silver compound as a water-soluble metal compound, the copper plate was uniformly blackened to significantly reduce the reflectance, and the smoothness of the surface and side of the copper circuit could be maintained.

Example 3

Silver paste comprising, as main components, 75 wt. % of silver powder (Silver Powder ST, produced by Dowa Hightech Co., Ltd.), 5 wt. % of glass frit (GF3550, produced by Okuno Chemical Industries Co., Ltd.), and 20 wt. % of oil (OIL-6018, produced by Okuno Chemical Industries Co., Ltd.) was prepared. The silver paste was screen-printed over the entire surface of an alumina substrate (5 cm long×5 cm wide×0.5 mm thick), and sintered at 600° C. for 10 minutes, thereby forming a silver paste film on the alumina substrate.

Blackening treatment of the silver paste film was performed in the same manner as in Example 1, except that a ceramic substrate on which the above silver paste film was formed was used as an object to be treated. Further, as in Example 1, the color tone of each sample after the treatment was observed, and the reflectance of light at a wavelength of 400 nm and 700 nm was measured. The treatment solutions used herein had the same compositions as those of the blackening treatment solutions Nos. 1 to 10 used in Example 1, and the blackening treatment solutions Nos. 11 to 30 used in Example 2. Tables 6 and 7 below show the results.

TABLE 6

| Type of blackening treatment solution | | Color of silver paste film | Reflectance (%) Wavelength (λ) 400 nm | 700 nm |
|---|---|---|---|---|
| Untreated | | Light gray | 64.09 | 84.59 |
| Blackening treatment solution No. | 1 | Black | 15.1 | 18.5 |
| | 2 | Black | 14.9 | 17.4 |
| | 3 | Black | 13.7 | 17.2 |
| | 4 | Black | 15.6 | 18.3 |
| | 5 | Black | 15.0 | 18.7 |
| | 6 | Black | 13.7 | 16.9 |
| | 7 | Black | 16.8 | 18.3 |
| | 8 | Black | 14.1 | 15.1 |
| | 9 | Black | 16.2 | 17.6 |
| | 10 | Black | 17.6 | 18.8 |
| | 11 | Black | 13.5 | 16.2 |
| | 12 | Black | 13.9 | 16.6 |
| | 13 | Black | 14.7 | 17.8 |
| | 14 | Black | 16.2 | 18.9 |
| | 15 | Black | 13.8 | 15 |
| | 16 | Black | 14.5 | 15.7 |
| | 17 | Black | 14.9 | 15.4 |
| | 18 | Black | 14.1 | 15.9 |
| | 19 | Black | 15.8 | 16.7 |
| | 20 | Black | 16.1 | 17.3 |

TABLE 7

| Type of blackening treatment solution | | Color of silver paste film | Reflectance (%) Wavelength (λ) 400 nm | 700 nm |
|---|---|---|---|---|
| Untreated | | Light gray | 64.09 | 84.59 |
| Blackening treatment solution No. | 21 | Black | 13.9 | 15.2 |
| | 22 | Black | 16.6 | 18.1 |
| | 23 | Black | 13.2 | 15.4 |
| | 24 | Black | 15.8 | 16.7 |
| | 25 | Black | 13.1 | 15.5 |
| | 26 | Black | 12.9 | 14.6 |
| | 27 | Black | 14.6 | 16.1 |
| | 28 | Black | 13.1 | 15.2 |
| | 29 | Black | 14.4 | 16.3 |
| | 30 | Black | 15.1 | 18.4 |

As is clear from the above results, it was confirmed that even when an article in which a silver paste film was formed was used as an object to be treated, the silver paste film was uniformly blackened to significantly reduce the reflectance by performing blackening treatment using the blackening treatment solutions Nos. 1 to 30, which were the compositions for blackening treatment of the present invention.

The invention claimed is:

1. A composition for blackening treatment of a copper-based metal or a silver-based metal, the composition comprising an aqueous solution containing:

(i) at least one water-soluble metal compound selected from the group consisting of water-soluble palladium compounds, water-soluble ruthenium compounds, and water-soluble silver compounds;

(ii) at least one halide selected from the group consisting of hydrohalic acids, metal halides, and ammonium halides; and (iii) at least one nitrogen atom-containing compound selected from the group consisting of alkylene diamines, polyalkylene polyamines, polyamide polyamines, and crosslinked polyamide polyamines.

2. A composition for blackening treatment of a copper-based metal or a silver-based metal, the composition comprising an aqueous solution containing:

(i) 0.0001 to 0.5 mol/L, as the concentration of a metal component, of at least one water-soluble metal compound selected from the group consisting of water-soluble palladium compounds, water-soluble ruthenium compounds, and water-soluble silver compounds;

(ii) 0.1 to 500 g/L of at least one halide selected from the group consisting of hydrohalic acids, metal halides, and ammonium halides; and (iii) 0.001 to 100 g/L of at least one nitrogen atom-containing compound selected from the group consisting of alkylene diamines, polyalkylene polyamines, polyamide polyamines, and crosslinked polyamide polyamines.

3. A method for blackening a copper-based metal or a silver-based metal, the method comprising bringing an object to be treated into contact with the composition for blackening treatment according to claim 1, the object to be treated being an article containing a copper-based metal comprising copper or a copper alloy, or an article containing a silver-based metal comprising silver or a silver alloy.

4. A method for blackening a copper-based metal or a silver-based metal, the method comprising bringing an object to be treated into contact with the composition for blackening treatment according to claim 2, the object to be treated being an article containing a copper-based metal comprising copper or a copper alloy, or an article containing a silver-based metal comprising silver or a silver alloy.

* * * * *